US010773176B2

(12) United States Patent
Zhao et al.

(10) Patent No.: US 10,773,176 B2
(45) Date of Patent: Sep. 15, 2020

(54) DEVICE CONTROL SYSTEM, METHOD, AND APPARATUS, AND CONTROL DEVICE

(71) Applicant: TENCENT TECHNOLOGY (SHENZHEN) COMPANY LIMITED, Shenzhen (CN)

(72) Inventors: Ming Zhao, Shenzhen (CN); Qingwei He, Shenzhen (CN); Sixi Lu, Shenzhen (CN); Chuankang Fan, Shenzhen (CN); Lujie Kang, Shenzhen (CN); Chao Gong, Shenzhen (CN); Yanqing Jing, Shenzhen (CN); Zhe Zhu, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 28 days.

(21) Appl. No.: 16/043,868

(22) Filed: Jul. 24, 2018

(65) Prior Publication Data

US 2018/0326315 A1 Nov. 15, 2018

Related U.S. Application Data

(63) Continuation of application No. PCT/CN2017/083156, filed on May 5, 2017.

(30) Foreign Application Priority Data

May 6, 2016 (CN) ..... 2016 1 0298374

(51) Int. Cl.

| | |
|---|---|
| ***A63H 30/04*** | (2006.01) |
| ***A63F 9/14*** | (2006.01) |
| ***A63H 17/36*** | (2006.01) |

(52) U.S. Cl.
CPC ..... *A63H 30/04* (2013.01); *A63F 9/143* (2013.01); *A63H 17/36* (2013.01)

(58) Field of Classification Search
CPC ..... A63H 30/04; A63H 17/36; A63F 9/143
(Continued)

(56) References Cited

U.S. PATENT DOCUMENTS

| | | | | |
|---|---|---|---|---|
| 2003/0082987 A1* | 5/2003 | Baumgartner | ..... | A63H 30/04 446/175 |
| 2005/0186884 A1* | 8/2005 | Evans | ..... | A63H 17/14 446/456 |

(Continued)

FOREIGN PATENT DOCUMENTS

| | | |
|---|---|---|
| CN | 201978498 U | 9/2011 |
| CN | 105214302 A | 1/2016 |

(Continued)

OTHER PUBLICATIONS

The World Intellectual Property Organization (WIPO) International Search Report for PCT/CN2017/083156 dated Aug. 2, 2017 6 Pages (including translation).

(Continued)

*Primary Examiner* — Nini F Legesse
(74) *Attorney, Agent, or Firm* — Anova Law Group, PLLC

(57) ABSTRACT

A device control system, method, and apparatus are provided. The system includes a control device and at least two battle game devices. The control device is configured to: establish a connection to a first battle game device, and send a control instruction to the first battle game device during a battle game according to a received external control operation. The first battle game device is configured to battle according to the control instruction. The second battle game device is configured to: obtain a relative position of the first (Continued)

battle game device during the battle game, and automatically battle according to the relative position.

17 Claims, 8 Drawing Sheets

(58) Field of Classification Search
USPC ..... 446/454
See application file for complete search history.

(56) References Cited

U.S. PATENT DOCUMENTS

2006/0019575 A1* 1/2006 Saeki ..... A63H 30/04 446/456
2006/0111014 A1* 5/2006 Hayashi ..... A63H 30/04 446/456
2008/0311821 A1* 12/2008 Hu ..... A63H 13/02 446/456
2009/0284553 A1* 11/2009 Seydoux ..... A63F 13/10 345/649
2010/0093255 A1* 4/2010 Yamamoto ..... A63F 9/0291 446/456
2013/0190090 A1 7/2013 Lin
2015/0253771 A1 9/2015 Stuckman

FOREIGN PATENT DOCUMENTS

CN 105279947 A 1/2016
CN 105311841 A 2/2016
CN 105413168 A 3/2016
CN 105999729 A 10/2016
WO 02059753 A1 8/2002

OTHER PUBLICATIONS

The State Intellectual Property Office of the People's Republic of China (SIPO) Office Action 1 for 201610298374.5 dated Mar. 2, 2018 17 Pages (including translation).

* cited by examiner

DEVICE CONTROL SYSTEM, METHOD, AND APPARATUS, AND CONTROL DEVICE

RELATED APPLICATION

This application is a continuation application of PCT Patent Application No. PCT/CN2017/083156, filed on May 5, 2017, which claims priority to Chinese Patent Application No. 201610298374.5, filed with the Chinese Patent Office on May 6, 2016, and entitled "DEVICE CONTROL SYSTEM, METHOD, AND APPARATUS", the entire contents of all of which are incorporated herein by reference.

FIELD OF THE TECHNOLOGY

Embodiments of the present disclosure relate to the field of data processing technologies, and in particular, to a device control system, method, and apparatus and a control device.

BACKGROUND OF THE DISCLOSURE

With the development of remote control technologies, people can use wireless remote controllers to control battle game devices to play a battle game. The battle game devices may be smart battle toy cars, smart battle toy planes, and the like.

When a battle game is performed between the battle game devices, players use the wireless remote controllers to separately control their battle game devices, and instructs the battle game devices to move or launch attacks. For example, a player instructs the wireless remote controller to send an attack instruction to the corresponding the battle game device by pressing a specified push-button on the wireless remote controller. After receiving the attack instruction, the battle game device simulates an attack by transmitting an infrared ray. After receiving the infrared ray, another battle game device automatically simulates an attacked status, and performs an action such as tip-over or stopping.

However, the existing technology has the following problem: when a battle game is performed between the battle game devices, at least two players are needed to separately control their battle game devices. When the quantity of players is less than 2, the battle game cannot be performed.

SUMMARY

In order to resolve problem of the foregoing technology, the embodiments of the present disclosure provide a device control system, method, and apparatus, and a control device. The technical solutions are as follows:

According to one aspect of the embodiments of the present disclosure, a device control system is provided, the system including a control device and at least two physical battle game devices. The control device is configured to: establish a connection to a first battle game device, and send a control instruction to the first battle game device during a battle game according to a received external control operation. The at least two battle game devices includes the first battle game device and a second battle game device. The first battle game device is configured to battle according to the control instruction. The second battle game device is configured to: obtain a relative position of the first battle game device during the battle game, and automatically battle according to the relative position.

According to another aspect of the embodiments of the present disclosure, a device control method is provided. The method is applied to a control device and includes establishing a connection to a first battle game device. The method also includes sending a control instruction to the first battle game device according to a received external control operation during a battle game. The control instruction is used to instruct the first battle game device to battle with a second battle game device according to the control instruction. The second battle game device is configured to: obtain a relative position of the first battle game device during the battle game, and automatically battle according to the relative position.

According to another aspect of the embodiments of the present disclosure, a control device is provided. The control device includes: one or more processors; and a memory. The one or more processors are configured to perform: establishing a connection to a first battle game device; and sending a control instruction to the first battle game device according to a received external control operation during a battle game. The control instruction is used to instruct the first battle game device to battle with a second battle game device according to the control instruction. The second battle game device is configured to: obtain a relative position of the first battle game device during the battle game, and automatically battle according to the relative position.

According to another aspect of the embodiments of the present disclosure, a non-transitory storage medium is provided. The storage medium stores computer program instructions executable by at least one processor. The computer program instructions can cause the at least one processor to perform: establishing a connection to a first battle game device; and sending a control instruction to the first battle game device according to a received external control operation during a battle game. The control instruction is used to instruct the first battle game device to battle with a second battle game device according to the control instruction. The second battle game device is configured to: obtain a relative position of the first battle game device during the battle game, and automatically battle according to the relative position.

BRIEF DESCRIPTION OF THE DRAWINGS

To describe the technical solutions of the embodiments of the present disclosure more clearly, the following briefly introduces the accompanying drawings required for describing the embodiments. Apparently, the accompanying drawings in the following description show merely some embodiments of the present disclosure, and a person of ordinary skill in the technology may still derive other drawings from these accompanying drawings without creative efforts.

DESCRIPTION OF EMBODIMENTS

To make the objectives, technical solutions, and advantages of the present disclosure clearer, the following further describes implementations of the present disclosure in detail with reference to the accompanying drawings.

It should be understood that "multiple" mentioned herein means two or more. "And/or" describes an association relationship of associated objects and represents that three relationships may exist. For example, A and/or B may represent the following three cases: Only A exists, both A and B exist, and only B exists. The character "/" usually indicates an "or" relationship between the associated objects.

To facilitate understanding, terms in the embodiments of the present disclosure are explained below.

Battle, or battle game, is a contest behavior between at least two devices. Battles between devices may include combatant battles and non-combatant battles. Devices performing the combatant battles can launch attacks to each other, and the attacks include, but are not limited to, physical attacks (for example, transmitting/shooting a physical attack item) and simulated attacks (for example, transmitting a simulated attack signal). Devices performing the non-combatant battles cannot launch attacks. For example, the non-combatant battle may be a racing behavior between the devices.

Figure 1:
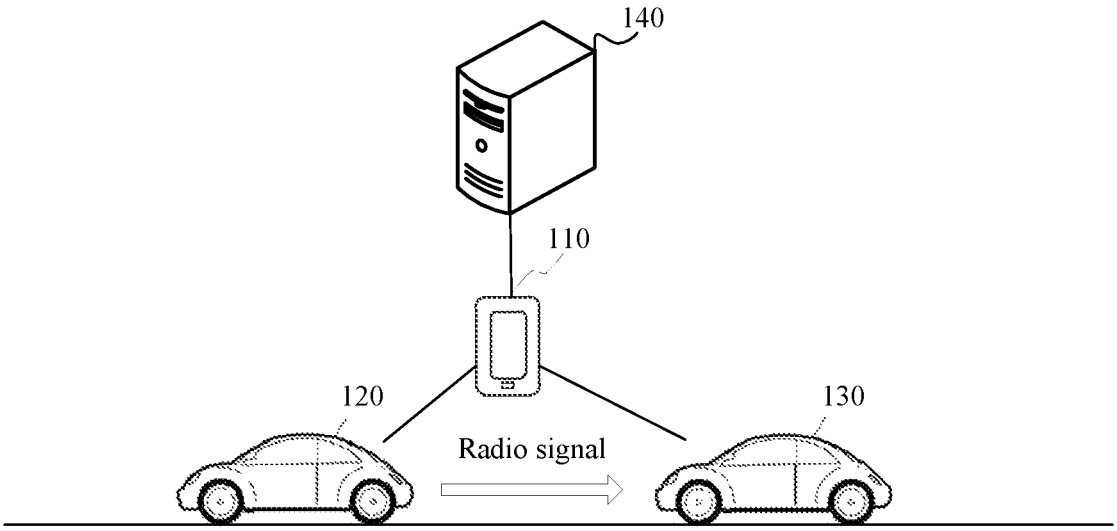
FIG. 1 is a schematic structural diagram of a device control system according to an embodiment of the present disclosure.

Referring to FIG. 1, FIG. 1 is a schematic structural diagram of a device control system according to an embodiment of the present disclosure. The system includes a control device 110, a first battle game device 120, and a second battle game device 130.

An application program for controlling a battle game device runs in the control device 110, and the control device 110 controls the first battle game device 120 by using the application program. The control device 110 may be a smartphone, a tablet computer, an e-book reader, an MP3 (Moving Picture Experts Group Audio Layer III) player, an MP4 (Moving Picture Experts Group Audio Layer IV) player, a laptop portable computer, or the like. FIG. 1 is described by using an example in which the control device 110 is a smartphone, and does not limit the present disclosure.

The control device 110 is connected to the first battle game device 120 in a manner such as Bluetooth or infrared.

The first battle game device 120 is a battle game device having a battle function. The first battle game device 120 may be a smart battle toy car, a smart battle toy plane, or the like. FIG. 1 is described by using an example in which both the first battle game device 120 and the second battle game device 130 are smart battle toy cars, and does not limit the present disclosure. The first battle game device 120 can receive an attack signal transmitted by another battle game device or transmits an attack signal to another battle game device by using a built-in transceiver component. Moreover, the first battle game device 120 receives a control instruction sent by the control device 110 by means of the connection to the control device 110, and performs a corresponding action according to the control instruction.

Similar to the first battle game device 120, the second battle game device 130 is also a battle game device having a battle function. Different from the first battle game device 120, the second battle game device 130 has an automatic control capability. The automatic control capability may be implemented by adding an additional automatic control module or enabling the automatic control function of the second battle game device 130. Optionally, to implement an automatic battle with the help of the automatic control capability, the second battle game device 130 receives a radio signal broadcast by the first battle game device 120 by using at least two radio receiver components disposed around a body of the second battle game device 130, determines a relative position of the first battle game device 120 according to position information of the radio receiver components receiving the received radio signal, and finally battles according to the relative position.

Optionally, the control device 110 is connected to the second battle game device 130 in a manner such as Bluetooth or infrared.

When the second battle game device 130 launches an attack to another battle game device or is attacked by another battle game device, the second battle game device 130 further sends corresponding attack data or attacked data to the control device 110 by means of the connection to the control device 110.

Optionally, the device control system may further include a server 140. The server 140 is connected to the control device 110 by using a wired or wireless network.

The server 140 may be at least one server, a server cluster, a distributed server platform, a cloud computing center, or a combination of several server clusters. When the system includes the server 140, the control device 110 is used as a transfer from the server 140 to the first battle game device 120 and the second battle game device 130, and is configured to: send received battle game data (including the attack data, the attacked data, and the like) to the server 140, receives status update data (including a health point, a battle score, a battle game device status, and the like) obtained by the server 140 by means of settlement/calculation according to the battle game data, and delivers the status update data to the first battle game device 120 and the second battle game device 130.

It should be noted that, this embodiment is described by using only an example in which the device control system includes a control device and two battle game devices. In other possible implementations, the device control system may include n control devices and (n+m) battle game devices, where $n \geq 2$, $m \geq 1$, and the (n+m) battle game devices include n first battle game devices and m second battle game devices (that is, n players control the n battle game devices and add m automatic battle game devices). The quantities of control devices and battle game devices included in the device control system are not limited in this embodiment of the present disclosure.

In the device control system shown in FIG. 1, the control device 110 is configured to establish a connection to the first battle game device 120.

Before a battle, a player uses the control device to establish a wireless connection to the first battle game device. The control device may establish a connection to the first battle game device in a manner such as Bluetooth or infrared.

The control device 110 is further configured to send a corresponding control instruction to the first battle game device 120 according to a received external control operation during the battle game.

During the battle game, the player controls the first battle game device by using the control device. Specifically, the control device receives an external control operation triggered by the player, and sends a corresponding control instruction to the first battle game device according to the control operation. The control instruction is used for instructing the first battle game device to move forward, move backward, make a turn, attack, and the like.

Figure 2:
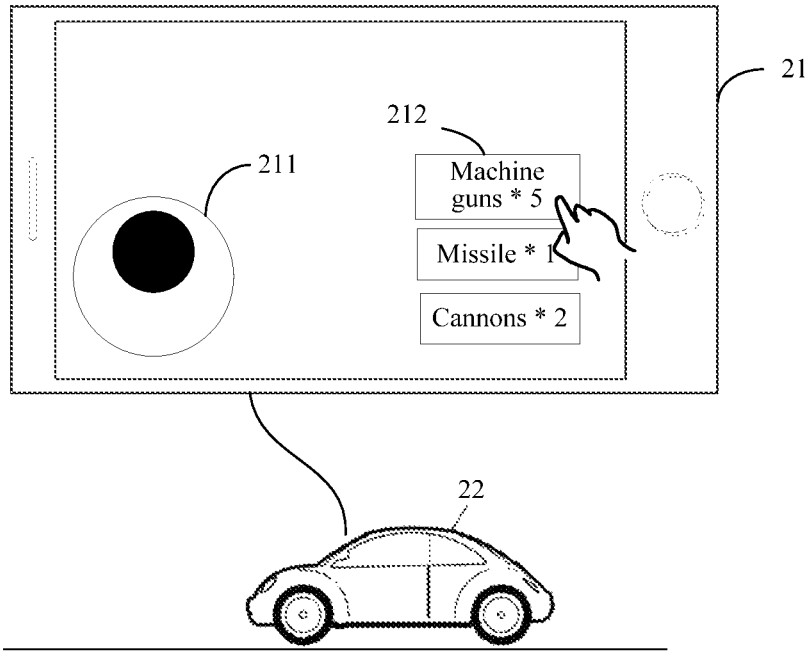
FIG. 2 is a schematic implementation diagram of controlling a first battle game device by a control device in the device control system shown in FIG. 1.

As shown in FIG. 2, a control device 21 displays a control interface. The control interface includes a direction control component 211 and an attack component 212. The control device 21 receives an external control operation of a player by using the components, and sends a corresponding control instruction to a first battle game device 22.

The first battle game device 120 is configured to battle according to the control instruction.

Correspondingly, the first battle game device 120 battles according to the received control instruction.

The second battle game device 130 is configured to: obtain a relative position of the first battle game device during the battle game, and automatically battle according to the relative position.

For the second battle game device preconfigured with automatic control logic, the second battle game device obtains the relative position of the first battle game device in real time during the battle game, and determines, according to the relative position and the automatic control logic, a battle action to be performed. The second battle game device may perform a battle action such as automatic following, automatic attack, or the like.

For example, after obtaining the relative position of the first battle game device, the second battle game device drives, according to the preconfigured automatic control logic, towards a direction in which the first battle game device is located, thereby achieving an effect of automatic following. For another example, the second battle game device may send, according to the preset automatic control logic, an attack signal towards a direction in which the first battle game device is located, thereby achieving an effect of automatic attack.

In conclusion, according to the device control system provided in this embodiment, by providing an automatic battle function for the second battle game device, when a user manually controls the first battle game device by using the control device, the second battle game device can simulates an effect of battling with the first battle game device according to a position of the first battle game device, to resolve a problem that when a battle is performed between the battle game devices, at least two players are needed to separately control their battle game devices, and when the quantity of players is less than 2, the battle cannot be performed; and achieving an effect that a single player can perform a battle between battle game devices by adding a battle game device having an automatic battle function.

To simulate a more realistic battle scenario, the control device may further establish a connection to the second battle game device before the battle game. During the battle game, the first battle game device and the second battle game device may launch attacks to each other, and report corresponding attack data and attacked data to the control device when the first battle game device and the second battle game device launches the attacks or are attacked. The control device updates and delivers a device status of each battle game device according to received data. The first battle game device and the second battle game device simulate different battle effects according to the delivered device statuses.

In a possible implementation, each battle game device supports two battle statuses, that is, a manual control state and an automatic control state, and a battle status used by a battle game device for the battle is set by the player. After the control device is connected to the first battle game device and the second battle game device, the player may set, on a corresponding setting interface, that the first battle game device battles by using the manual control state, and the second battle game device battles by using the automatic control state.

It should be noted that, in another possible implementation, a switch for switching a battle status may be disposed on a body of a battle game device, and a player may set the battle game device to enable the automatic control state by rocking the switch. Alternatively, when a battle game device does not support automatic control, an additional automatic control module may alternatively be mounted on the battle game device to support the automatic control.

The control device 110 is further configured to, during the battle game, deliver status update data to the first battle game device 120 and the second battle game device 130 according to battle game data reported by the first battle game device 120 and the second battle game device 130, where the status update data is obtained by means of calculation according to the battle game data.

The battle game data includes attack data reported by an attacker when the attacker launches an attack and attacked data reported by an attacked party when the attacked party is attacked. The attacker is one of the first battle game device and the second battle game device, and the attacked party is the other of the first battle game device and the second battle game device. The status update data includes at least one of a health point, a battle score, and a battle game device status.

In a possible implementation, for an attacked party, the control device increases a health point of the attacked party by a value according to attacked data reported by the attacked party, reduces a battle score by a preset value, and determines a battle game device status of the attacked party according to the reduced health point; for an attacker, the control device increases a corresponding battle score of the attacker by a preset value according to attack data reported by the attacker.

After receiving the status update data, the first battle game device and the second battle game device performs preset actions. For example, when a health point in the status update data is less than a preset health point, the battle game device emits an alert sound or emits flashing light; when battle game device status indication in the status update data is a serious damage state, the battle game device automatically stops after continuing battling for a preset period of time.

Figure 3:
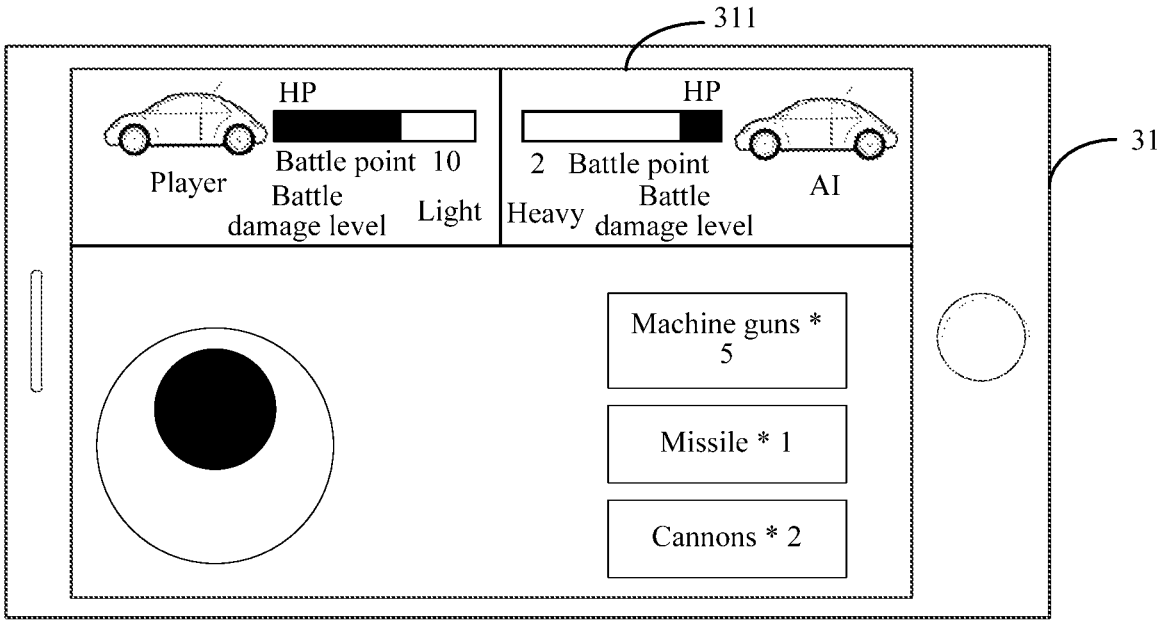
FIG. 3 is a schematic implementation diagram of displaying status update data by a control device in the device control system shown in FIG. 1.

To make players intuitively know status of each battle game device performing the battle, the control device may display the status update data. For example, as shown in FIG. 3, a control device 31 displays current status data of each battle game device in a status display area 311 according to status update data that is obtained by means of calculation, facilitating knowledge of a player.

In another possible implementation, the control device may report received battle game data to a server. The server performs settlement according to the battle game data, and delivers, by using the control device to the first battle game device and the second battle game device, status update data that is obtained by means of settlement.

The control device 110 is further configured to: during the battle game, receive battle game data reported by the first battle game device 120 and the second battle game device 130; send the battle game data to a server 140; receive status update data sent by the server 140, where the status update data is obtained by means of calculation according to the battle game data; and deliver the status update data to the first battle game device 120 and the second battle game device 130.

After establishing the connection to the first battle game device and the second battle game device, the control device may send a room creation request to the server, to request to create a battle room on a server end. After receiving the room creation request, the server allocates a battle room and a corresponding room number for the control device, and adds the first battle game device and the second battle game device into the battle room. Specifically, the server may perform associative storage on status data of the first battle game device and the second battle game device with the room number.

During a battle game, the first battle game device and the second battle game device send battle game data to the control device. The control device sends a corresponding data settlement request to the server according to the received battle game data and the allocated room number. The server obtains, according to the room number included in the data settlement request, current status data the first battle game device and the second battle game device that are in the battle room indicated by the room number, and obtains status update data by means of settlement according to the current status data and the battle game data. The server sends the status update data obtained by means of settlement to the control device, and the control device delivers the status update data to the first battle game device and the second battle game device. Correspondingly, the first battle game device and the second battle game device simulate a battle effect such as battle damage or damage according to the status update data.

In this embodiment, when the battle game devices launches attacks or are attacked, the battle game devices report corresponding attack data and attacked data to the control device. The control device or the server connected to the control device updates or delivers a device status of each battle game device according to the received data. Finally, the first battle game device and the second battle game device simulate a battle effect according to the delivered device statuses, thereby increasing the realness and interest of the battle process.

When the system includes more than two battle game devices, when the control device receives battle game data, matching needs to be performed on the battle game data, to determine an attacker and an attacked party in the battle game devices, and updates status data of a corresponding battle game device according to matched battle game data.

The control device 110 is further configured to: detect whether an attacker device identifier included in the attack data is the same as an attacker device identifier included in the attacked data; determine, if the attacker device identifiers are the same, that the attack data matches the attacked data; and determine status update data in response to the attack data matching the attacked data.

In a possible implementation, attack data reported by an attacker carries an attacker device identifier, and attacked data reported by an attacked party carries an attacked party device identifier and the attacker device identifier. When receiving multiple groups of attack data and attacked data at the same time, the control device performs matching according to attacker device identifiers that are carried in the attack data and attacked data.

For example, the control device receives multiple groups of attack data and attacked data, where an attacker device identifier included in attack data 1 is "device A"; an attacker device identifier included in attack data 2 is "device B"; an attacker device identifier included in attacked data 1 is "device A", and an attacked party device identifier is "device B"; an attacker device identifier included in attacked data 2 is "device B", and an attacked party device identifier is "device C". Because corresponding attacker device identifiers of the attack data 1 and the attacked data 1 are the same, the control device determines that the attack data 1 matches the attacked data 1, and further determines corresponding status update data of the device A and the device B. Similarly, because corresponding attacker device identifiers of the attack data 2 and the attacked data 2 are the same, the control device determines that the attack data 2 matches the attacked data 2, and further determines corresponding status update data of the device B and the device C.

In this embodiment, when receiving multiple groups of attack data and attacked data, the control device performs matching on the attack data and the attacked data according to a matching mechanism, and further updates status data of corresponding battle game devices according to matched battle game data, thereby avoiding a mistake of device status settlement caused by that the control device receives multiple groups of attack data and attacked data in a short time.

Before the battle game, the control device may receive an automatic control parameter that is set by the player for the second battle game device, and delivers, to the second battle game device, an automatic control configuration generated according to the automatic control parameter, so that the second battle game device can perform a corresponding action according to the automatic control configuration.

The control device 110 is further configured to: receive, before the battle game, an automatic control parameter that is set for the second battle game device 130, where the automatic control parameter includes at least one of an initial health point, an attack type, an attack probability, and an evasion probability of the second battle game device 130; generate an automatic control configuration according to the automatic control parameter; and deliver the automatic control configuration to the second battle game device.

The attack probability indicates a probability that the second battle game device 130 launches an attack, and the evasion probability indicates a probability that the second battle game device 130 evades an attack. When the control device establishes the connection to the second battle game device and instructs the second battle game device to enable the automatic control state, the control device displays a corresponding automatic control parameter setting interface, and receives the automatic control parameter set by the player. The automatic control parameter set by the player may be a simple automatic control level, or may be a group of specific parameters. In a possible implementation, the automatic control parameter may include at least one of an initial health point, an attack type, an attack probability, and an evasion probability of the second battle game device.

Figure 4:
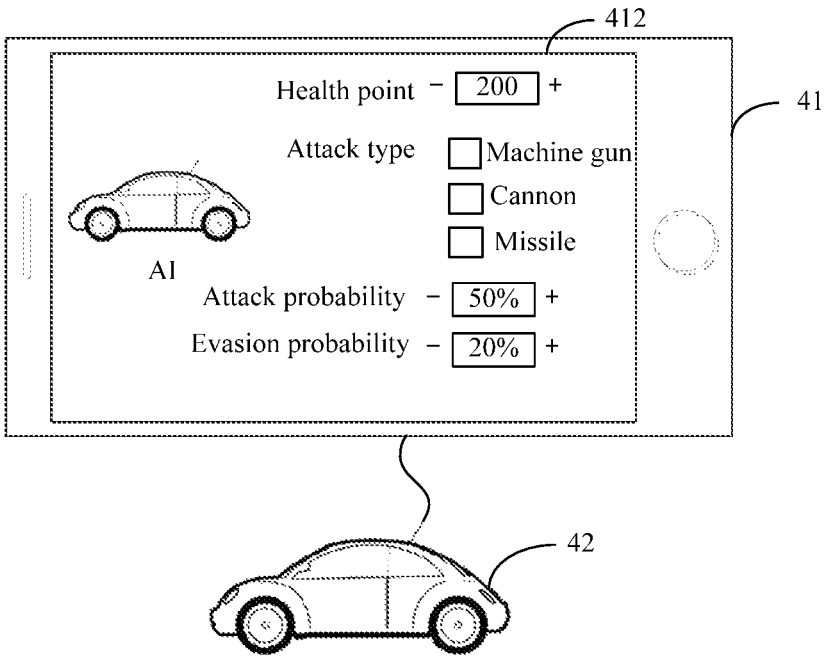
FIG. 4 is a schematic implementation diagram of delivering an automatic control configuration to a second battle game device by a control device in the device control system shown in FIG. 1.

The attack type indicates a type of an attack that can be launched by the second battle game device, and different attack types correspond to different attack damage values. The attack probability indicates a probability that the second battle game device launches an attack. Specifically, for different attack types, the player may set an attack probability corresponding to each of the attack types. The evasion probability indicates a probability that the second battle game device evades an attack of another battle game device. For example, as shown in FIG. 4, after controlling a second battle game device 42 to enable the automatic control state, a control device 41 receives, by using an automatic control parameter setting interface 412, an automatic control parameter set by a user, and delivers a generated automatic control configuration to the second battle game device 42. It should be noted that, the player may also set a defense value of the second battle game device, set preferential automatic control (for example, preferential attack or preferential evasion) of the second battle game device, or the like. This is not limited in this embodiment of the present disclosure.

The second battle game device 130 is further configured to automatically battle according to the relative position of the first battle game device 120 and the automatic control configuration.

In a possible implementation, the evasion probability is a probability that the second battle game device reports attacked data to the control device when the second battle game device is attacked by another battle game device. For example, when the evasion probability set for the second battle game device is 50%, after the second battle game device is attacked by the first battle game device, the second battle game device has a probability of 50% to report attacked data to the control device. In a case in which the second battle game device does not report the attacked data, even though the first battle game device reports attack data, because the control device does not receive attacked data matching the attack data, the control device determines that the attack launched by the first battle game device misses, thereby simulating an effect that the second battle game device evades the attack.

To simulate an effect of player control, after obtaining a position of the first battle game device in real time, the second battle game device determines, according to the automatic control configuration, an action to be performed. For example, when the second battle game device learns that the first battle game device is located in front of the second battle game device, and automatic control logic instructed in the automatic control configuration is to launch a missile to the front battle game device, the second battle game device transmits an attack signal to the front first battle game device by using a weapon launcher component. The attack signal is modulated with attack information that the attack type is a missile.

In this embodiment, the player may autonomously set the automatic control parameter for the battle game device, thereby enriching a battle mode, and increasing interest of the battle.

Because a processing capability of the second battle game device 130 is limited, the second battle game device can perform only a simple action (for example, automatic following or launching a missile to the front) according to the automatic control configuration. To make the second battle game device simulate a more realistic effect of player control, the second battle game device may simulate the battle with the help of a high processing capability of the control device.

The second battle game device 130 is further configured to send the relative position of the first battle game device 120 to the control device 110.

The second battle game device sends an obtained relative position of the first battle game device to the control device by means of the connection to the control device. Optionally, the relative position is used for indicating a relative position of the first battle game device to the second battle game device. The relative position includes a front side, a rear side, a left side, a right side, front left, rear back, front right, and rear right. The control device 110 is further configured to: generate a corresponding execution instruction according to the relative position, a current status of the first battle game device 120, a current status of the second battle game device 130, and preset control logic; and send the execution instruction to the second battle game device 130.

In the control device, a real-time status of each battle game device connected to the control device is maintained. When the relative position of the first battle game device sent by the second battle game device is received, the execution instruction is generated by integrating a current status of each battle game device, the relative position, and the preset control logic. Because the control device has a high processing capability, the execution instruction generated by integrating a large volume of data can simulate a more realistic effect of player control.

The second battle game device 130 is further configured to: receive the execution instruction; and perform a corresponding action according to the execution instruction.

Correspondingly, the second battle game device performs the corresponding action according to the received execution instruction, thereby simulating realistic effect of player control.

In this embodiment, during the battle game, the second battle game device transmits data and an instruction to the control device in real time with help of the processing capability of the control device, so that the second battle game device can automatically battle according to more complex automatic control logic, thereby increasing the realness of the battle.

In a possible implementation, a radio transmitter component for broadcasting a radio signal is disposed on the first battle game device. At least two radio receiver components are disposed on the second battle game device, and each radio receiver component corresponds to a radio signal receiving direction. the second battle game device determines the relative position according to position information provided by one or more of the at least two radio receiver components that have received the radio signal.

When the second battle game device obtains the relative position of the first battle game device, the first battle game device 120 is further configured to broadcast the radio signal by using the radio transmitter component during the battle game, where the radio signal is used for positioning.

The second battle game device 130 is further configured to: receive the radio signal by using at least two radio receiver components, where the at least two radio receive components each have corresponding receiving directions; and determine the relative position of the first battle game device to the second battle game device according to position information of the radio receive components receiving the radio signal.

When the player uses the second battle game device to battle with the first battle game device, the first battle game device circularly broadcasts a preset radio signal around by using a built-in radio transmitter component. The radio signal carries a device identifier of the first battle game device. The radio transmitter component may be an infrared transmitter diode or a laser transmitter diode. Correspondingly, the radio signal is a modulated infrared signal or laser signal. This is not limited in this embodiment.

Optionally, the radio signal includes a preset flag bit. Another battle game device may distinguish the radio signal and the attack signal by identifying the preset flag bit.

While the first battle game device broadcasts the radio signal, the second battle game device participating in the battle may receive the radio signal by using a radio receiver component disposed around a body of the battle game device. To make the second battle game device sense the relative position of the first battle game device according to the radio signal, at least two radio receiver components are disposed around the body of the second battle game device, and the at least two radio receiver components are disposed opposite to each other. Meanwhile, each radio receiver component has a corresponding radio signal receiving direction, and is configured to receive a radio signal from a specified direction. For example, two radio receiver components are correspondingly disposed at a front end and a rear end of the second battle game device, where the radio receiver component located at the front end is configured to receive a radio signal from the front side, and the radio receiver component located at the rear end is configured to receive a radio signal from the rear side.

In a possible implementation, as shown in 5, four radio receiver components are symmetrically disposed around a second battle game device 51, that is, a first radio receiver component 51*a*, a second radio receiver component 51*b*, a third radio receiver component 51*c*, and a fourth radio receiver component 51*d*, and the four radio receiver components are separately configured to receive a radio signal from the front side, the rear side, the left side, and the right side.

It should be noted that, in another possible implementation, more than four radio receiver components may be disposed around the second battle game device. A specific quantity of radio receiver components disposed around the second battle game device is not limited in this embodiment.

Because each of the radio receiver components in the second battle game device has the receiving direction, the radio receiver component cannot receive a radio signal from another receiving direction that is not the receiving direction. For example, the radio receiver component whose receiving direction is the front side cannot receive a radio signal from the rear side. Therefore, the radio signal broadcast by the first battle game device only can be received by some radio receiver components. The second battle game device may further determine the relative position of the first battle game device transmitting the radio signal according to position information of the radio receiver components receiving the radio signal.

Figure 5:
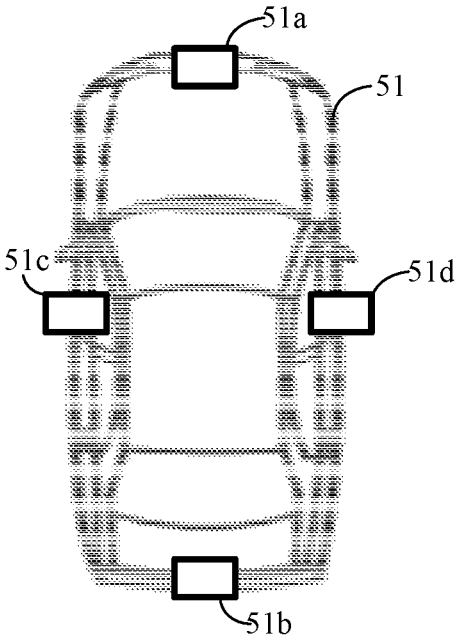
FIG. 5 is a schematic diagram of directions in which radio receiver components are disposed in a second battle game device.

With reference to the second battle game device 51 shown in FIG. 5, when the first the radio receiver component 51*a* receives the radio signal, it is determined that the first battle game device is located in front of the second battle game device.

When the second the radio receiver component 51*b* receives the radio signal, it is determined that the first battle game device is located at the rear side of the second battle game device.

When the third the radio receiver component 51*c* receives the radio signal, it is determined that the first battle game device is located at the left side of the second battle game device.

When the fourth the radio receiver component 51*d* receives the radio signal, it is determined that the first battle game device is located at the right side of the second battle game device.

When both the first the radio receiver component 51*a* and the third the radio receiver component 51*c* receive the radio signal, it is determined that the first battle game device is located at the front left side of the second battle game device.

When both the first the radio receiver component 51*a* and the fourth the radio receiver component 51*d* receive the radio signal, it is determined that the first battle game device is located at the front right side of the second battle game device.

When both the second the radio receiver component 51*b* and the third the radio receiver component 51*c* receive the radio signal, it is determined that the first battle game device is located at the rear left side of the second battle game device.

When both the second the radio receiver component 51*b* and the fourth the radio receiver component 51*d* receive the radio signal, it is determined that the first battle game device is located at the rear right side of the second battle game device.

In this embodiment, multiple radio receiver components are disposed around the second battle game device, so that the second battle game device not only determines, according to the position information of the radio receiver components receiving the radio signal, a relative position of the first battle game device to the second battle game device in a positive direction, but also may determine a relative position of the first battle game device to the second battle game device in an oblique direction more precisely, thereby improving the accuracy of determining the relative position.

Figure 6:
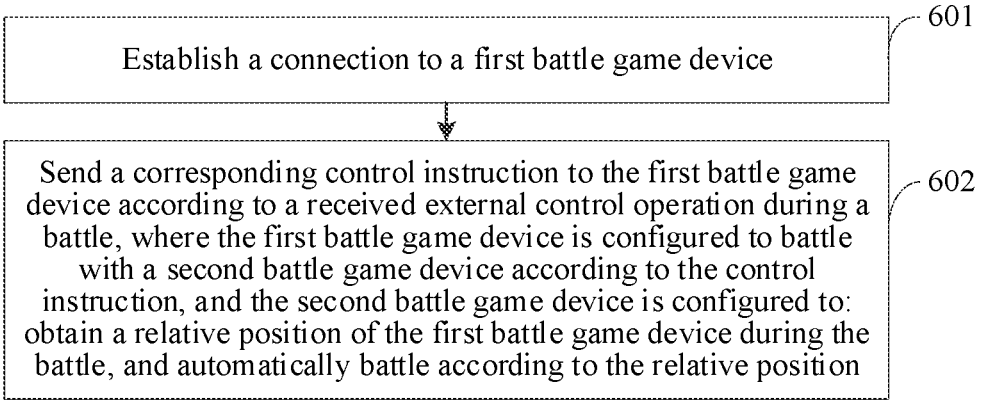
FIG. 6 is a flowchart of a device control method according to an embodiment of the present disclosure.

Referring to FIG. 6, FIG. 6 is a flowchart of a device control method according to an embodiment of the present disclosure. This embodiment is described by using an example in which the device control method is applied to the control device 110 shown in FIG. 1. The method includes the following steps:

Step 601: Establish a connection to a first battle game device.

Step 602: Send a corresponding control instruction to the first battle game device according to a received external control operation during a battle game, where the first battle game device is configured to battle with a second battle game device according to the control instruction, and the second battle game device is configured to: obtain a relative position of the first battle game device during the battle game, and automatically battle according to the relative position.

In conclusion, according to the device control method provided in this embodiment, by providing an automatic battle function for the second battle game device, when a user manually controls the first battle game device by using the control device, the second battle game device can simulates an effect of battling with the first battle game device according to a position of the first battle game device, to resolve a problem that when a battle is performed between the battle game devices, at least two players are needed to separately control their battle game devices, and when the quantity of players is less than 2, the battle cannot be performed; and achieving an effect that a single player can perform a battle between battle game devices by adding a battle game device having an automatic battle function.

Because a processing capability of a control chip in a second battle game device is limited, the second battle game device only can perform a simple action (for example, automatic following) according to a preset automatic control configuration, and cannot simulate different battle statuses during a battle game, for example, a battle damage state, a damage state, or the like. To make the second battle game device simulate a more realistic effect of a battle status, the second battle game device may simulate the battle with the help of a high processing capability of a control device.

Figure 7A:
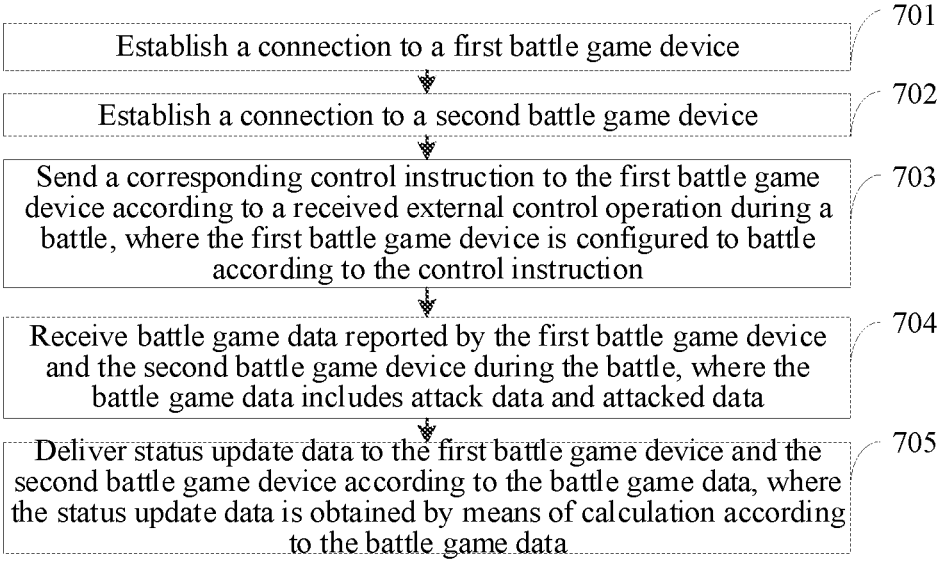
FIG. 7A is a flowchart of a device control method according to another embodiment of the present disclosure.

Referring to FIG. 7A, FIG. 7A is a flowchart of a device control method according to another embodiment of the present disclosure. This embodiment is described by using an example in which the device control method is applied to the control device 110 shown in FIG. 1. The method includes the following steps:

Step 701: Establish a connection to a first battle game device.

Before a battle, the control device may establish a connection to the first battle game device by using Bluetooth or infrared. Optionally, after establishing the connection to the first battle game device, the control device may instruct the first battle game device to enable a manual control state. In the manual control state, a user may manually control, by using the control device, the first battle game device to battle.

Step 702: Establish a connection to a second battle game device.

Similar to step 701, while establishing the connection to the first battle game device, the control device establishes the connection to the second battle game device. Optionally, after establishing the connection to the second battle game device, the control device may instruct the second battle game device to enable an automatic control state. In the automatic control state, the second battle game device automatically battle according to a preset automatic control configuration, and is not controlled by the user.

Step 703: Send a corresponding control instruction to the first battle game device according to a received external control operation during a battle game, where the first battle game device is configured to battle according to the control instruction.

For the first battle game device disabling the automatic control state, the control device sends the corresponding control instruction to the first battle game device according to the received external control operation, so that the first battle game device can battle according to the control instruction.

Step 704: Receive battle game data reported by the first battle game device and the second battle game device during the battle game, where the battle game data includes attack data and attacked data.

To simulate a realistic battle scenario, during the battle game, the first battle game device and the second battle game device may launch attacks to each other, and report corresponding attack data and attacked data to the control device when the first battle game device and the second battle game device launches the attacks or are attacked. Correspondingly, the control device receives the battle game data reported by the first battle game device and the second battle game device.

Step 705: Deliver status update data to the first battle game device and the second battle game device according to the battle game data, where the status update data is obtained by means of calculation according to the battle game data.

The status update data includes at least one of a health point, a battle score, and a battle game device status.

In a possible implementation, for an attacked party, the control device increases a health point of the attacked party by a value according to attacked data reported by the attacked party, reduces a battle score by a preset value, and determines a battle game device status of the attacked party according to the reduced health point; for an attacker, the control device increases a corresponding battle score of the attacker by a preset value according to attack data reported by the attacker.

After receiving the status update data, the first battle game device and the second battle game device performs preset actions. For example, when a health point in the status update data is less than a preset health point, the battle game device emits an alert sound or emits flashing light; when battle game device status indication in the status update data is a serious damage state, the battle game device automatically stops after continuing battling for a preset period of time.

In conclusion, according to the device control method provided in this embodiment, by providing an automatic battle function for the second battle game device, when a user manually controls the first battle game device by using the control device, the second battle game device can simulates an effect of battling with the first battle game device according to a position of the first battle game device, to resolve a problem that when a battle is performed between the battle game devices, at least two players are needed to separately control their battle game devices, and when the quantity of players is less than 2, the battle cannot be performed; and achieving an effect that a single player can perform a battle between battle game devices by adding a battle game device having an automatic battle function.

In this embodiment, when the battle game devices launches attacks or are attacked, the battle game devices report corresponding attack data and attacked data to the control device. The control device or the server connected to the control device updates or delivers a device status of each battle game device according to the received data. Finally, the first battle game device and the second battle game device simulate a battle effect according to the delivered device statuses, thereby increasing the realness and interest of the battle process.

Figure 7B:
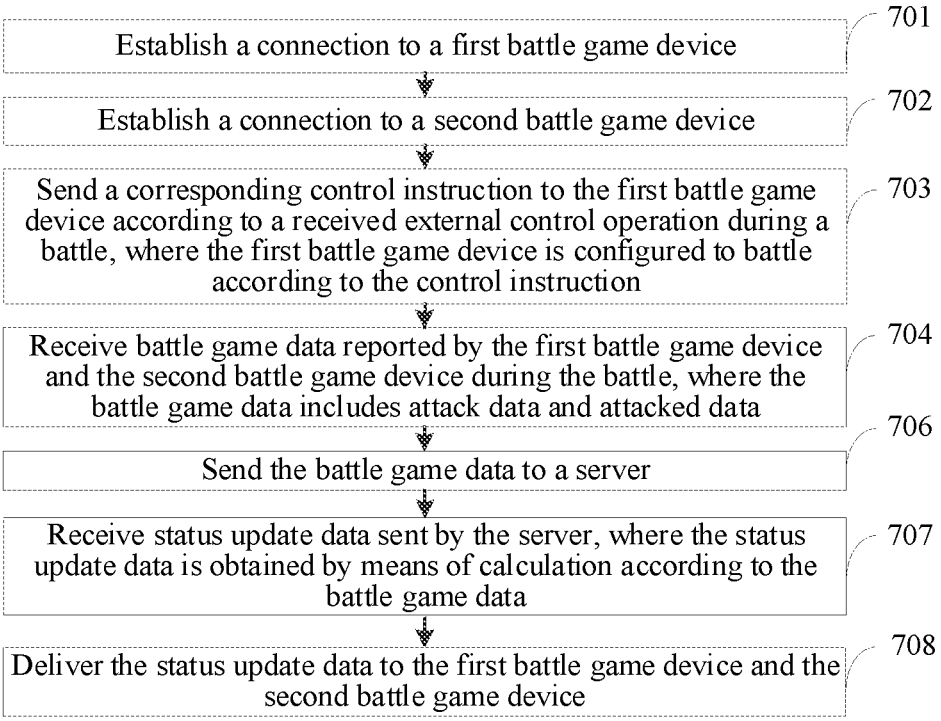
FIG. 7B is a flowchart of a device control method according to another embodiment of the present disclosure.

Based on the device control method shown in FIG. 7A, in a possible implementation, the control device may alternatively report the received battle game data to a server. The server performs settlement according to the battle game data, and delivers, by using the control device to the first battle game device and the second battle game device, status update data that is obtained by means of settlement. As shown in FIG. 7B, step 705 may be replaced by the following steps:

Step 706: Send the battle game data to a server.

The control device transfers the received battle game data to the server.

Correspondingly, after receiving the battle game data, the server obtains the status update data by means of settlement according to the battle game data, and sends the status update data to the server.

Step 707: Receive status update data sent by the server, where the status update data is obtained by means of calculation according to the battle game data Step 708: Deliver the status update data to the first battle game device and the second battle game device.

Similar to step 705, the control device delivers the status update data to the first battle game device and the second battle game device by means of the established connections, so that the first battle game device and the second battle game device perform a corresponding operation (for example, flashing a health point light) according to the status update data.

Based on the device control method shown in FIG. 7A, when a system includes more than two battle game devices, when receiving the battle game data, the control device needs to perform matching on the battle game data, and update status data of a corresponding battle game device according to matched battle game data. Optionally, the method further includes the following steps:

Step 709: Detect whether an attacker device identifier included in the attack data is the same as an attacker device identifier included in the attacked data.

The attack data reported by the attacker carries the attacker device identifier, and the attacked data reported by the attacked party carries an attacked party device identifier and the attacker device identifier. When receiving multiple groups of attack data and attacked data at the same time, the control device performs matching according to attacker device identifiers that are carried in the attack data and attacked data.

Step 710: Determine, if the attacker device identifiers are the same, that the attack data matches the attacked data.

For example, the control device receives multiple groups of attack data and attacked data, where an attacker device identifier included in attack data 1 is "device A"; an attacker device identifier included in attack data 2 is "device B"; an attacker device identifier included in attacked data 1 is "device A", and an attacked party device identifier is "device B"; an attacker device identifier included in attacked data 2 is "device B", and an attacked party device identifier is "device C". Because corresponding attacker device identifiers of the attack data 1 and the attacked data 1 are the same, the control device determines that the attack data 1 matches the attacked data 1, and further determines corresponding status update data of the device A and the device B. Similarly, because corresponding attacker device identifiers of the attack data 2 and the attacked data 2 are the same, the control device determines that the attack data 2 matches the attacked data 2, and further determines corresponding status update data of the device B and the device C.

After performing matching on the attack data and attacked data in the battle game data, the control device performs step 705, or performs step 706 to 708.

In this embodiment, when receiving multiple groups of attack data and attacked data, the control device performs matching on the attack data and the attacked data according to a matching mechanism, and further updates status data of corresponding battle game devices according to matched battle game data, thereby avoiding a mistake of device status settlement caused by that the control device receives multiple groups of attack data and attacked data in a short time.

Figure 7C:
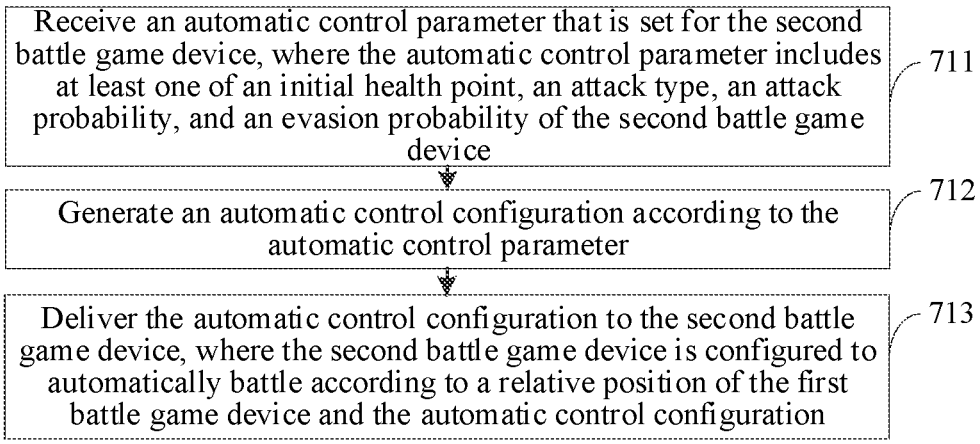
FIG. 7C is a flowchart of an automatic control configuration delivery process involved in the device control method provided in FIG. 7A.

Based on the device control method shown in FIG. 7A, as shown in FIG. 7C, after step 702, the method further includes the following steps:

Step 711: Receive an automatic control parameter that is set for the second battle game device, where the automatic control parameter includes at least one of an initial health point, an attack type, an attack probability, and an evasion probability of the second battle game device.

The automatic control parameter set by the player may be a simple automatic control level, or may be a group of specific parameters. This embodiment is described by using an example in which the automatic control parameter may include at least one of the initial health point, the attack type, the attack probability, and the evasion probability of the second battle game device, and this does not limit the present disclosure.

Step 712: Generating an automatic control configuration according to the automatic control parameter.

Step 713: Deliver the automatic control configuration to the second battle game device, where the second battle game device is configured to automatically battle according to a relative position of the first battle game device and the automatic control configuration.

To simulate an effect of player control, after obtaining a position of the first battle game device in real time, the second battle game device determines, according to the automatic control configuration, an action to be performed. For example, when the second battle game device learns that the first battle game device is located in front of the second battle game device, and automatic control logic instructed in the automatic control configuration is to launch a missile to the front battle game device, the second battle game device 130 transmits an attack signal to the front first battle game device by using a weapon launcher component. The attack signal is modulated with attack information that the attack type is a missile.

In this embodiment, the player may autonomously set the automatic control parameter for the battle game device, thereby enriching a battle mode, and increasing interest of the battle.

Figure 7D:
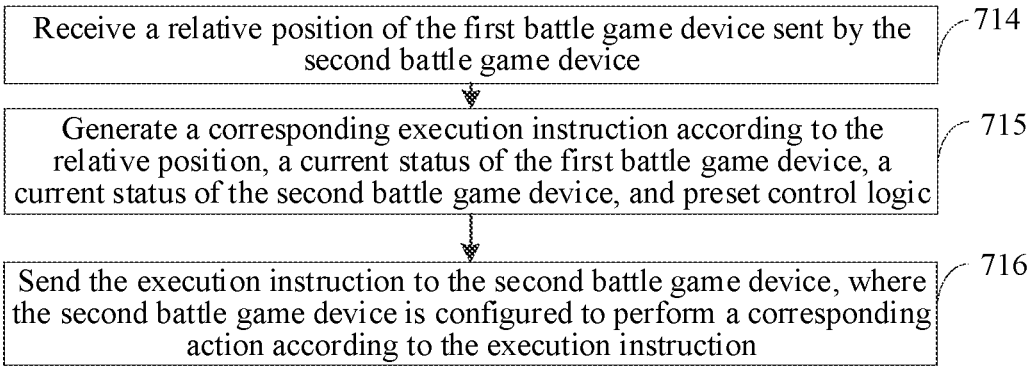
FIG. 7D is a flowchart of an execution instruction sending process involved in the device control method provided in FIG. 7A.

Based on the device control method shown in FIG. 7A, as shown in FIG. 7D, after step 703, the method further includes the following steps:

Step 714: Receive a relative position of the first battle game device sent by the second battle game device.

The second battle game device sends an obtained relative position of the first battle game device to the control device by means of the connection to the control device. Correspondingly, the control device receives the relative position.

Step 715: Generate a corresponding execution instruction according to the relative position, a current status of the first battle game device, a current status of the second battle game device, and preset control logic.

In the control device, a real-time status of each battle game device connected to the control device is maintained. When the relative position of the first battle game device sent by the second battle game device is received, the execution instruction is generated by integrating a current status of each battle game device, the relative position, and the preset control logic. Because the control device has a high processing capability, the execution instruction generated by integrating a large volume of data can simulate a more realistic effect of player control.

Step 716: Send the execution instruction to the second battle game device, where the second battle game device is configured to perform a corresponding action according to the execution instruction.

Correspondingly, the second battle game device performs the corresponding action according to the received execution instruction, thereby simulating realistic effect of player control.

In this embodiment, during the battle game, the second battle game device transmits data and an instruction to the control device in real time with help of the processing capability of the control device, so that the second battle game device can automatically battle according to more complex automatic control logic, thereby increasing the realness of the battle.

Figure 8:
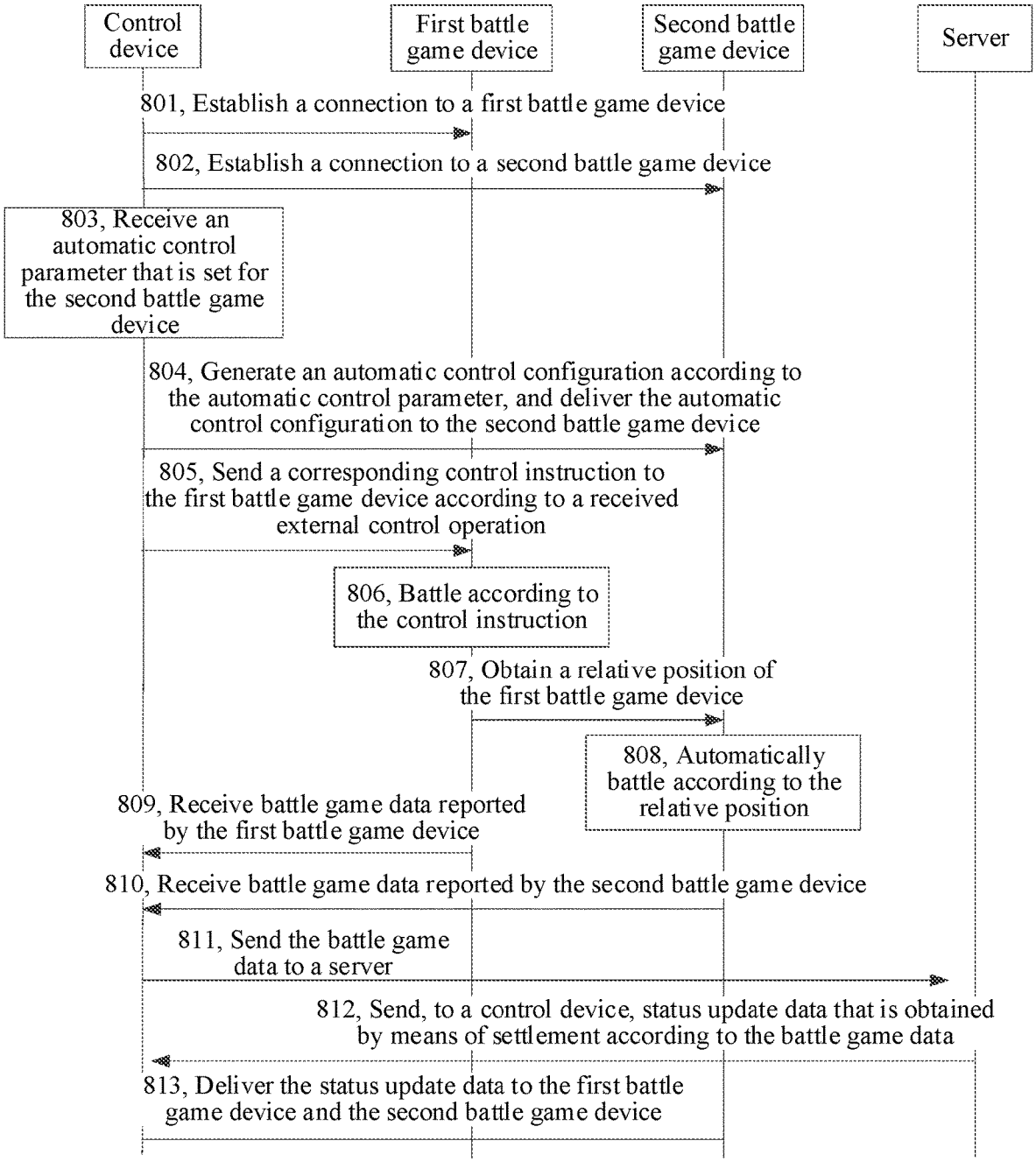
FIG. 8 is a flowchart of an interaction process of a control device with a first battle game device, a second battle game device, and a server.

With reference to the device control method provide in the embodiments, an interaction relationship of a control device with a first battle game device, a second battle game device, and a server is schematically shown in FIG. 8.

Step 801: The control device establishes a connection to the first battle game device.

Step 802: The control device establishes a connection to the second battle game device.

Step 803: The control device receives an automatic control parameter that is set for the second battle game device.

Step 804: The control device generates an automatic control configuration according to the automatic control parameter, and delivers the automatic control configuration to the second battle game device.

Step 805: The control device sends a corresponding control instruction to the first battle game device according to a received external control operation.

Step 806: The first battle game device battles according to the control instruction.

Step 807: The second battle game device receives a relative position of the first battle game device.

Step 808: The second battle game device automatically battles according to the relative position.

Step 809: The control device receives battle game data reported by the first battle game device.

Step 810: The control device receives battle game data reported by the second battle game device.

Step 811: The control device sends the battle game data to the server.

Step 812: The server send, to the control device, status update data that is obtained by means of settlement according to the battle game data.

Step 813: The control device delivers the status update data to the first battle game device and the second battle game device.

The following describes apparatus embodiments of the present disclosure. For details not described in the apparatus embodiments in detail, refer to the foregoing one-to-one corresponding method embodiments.

Figure 9:
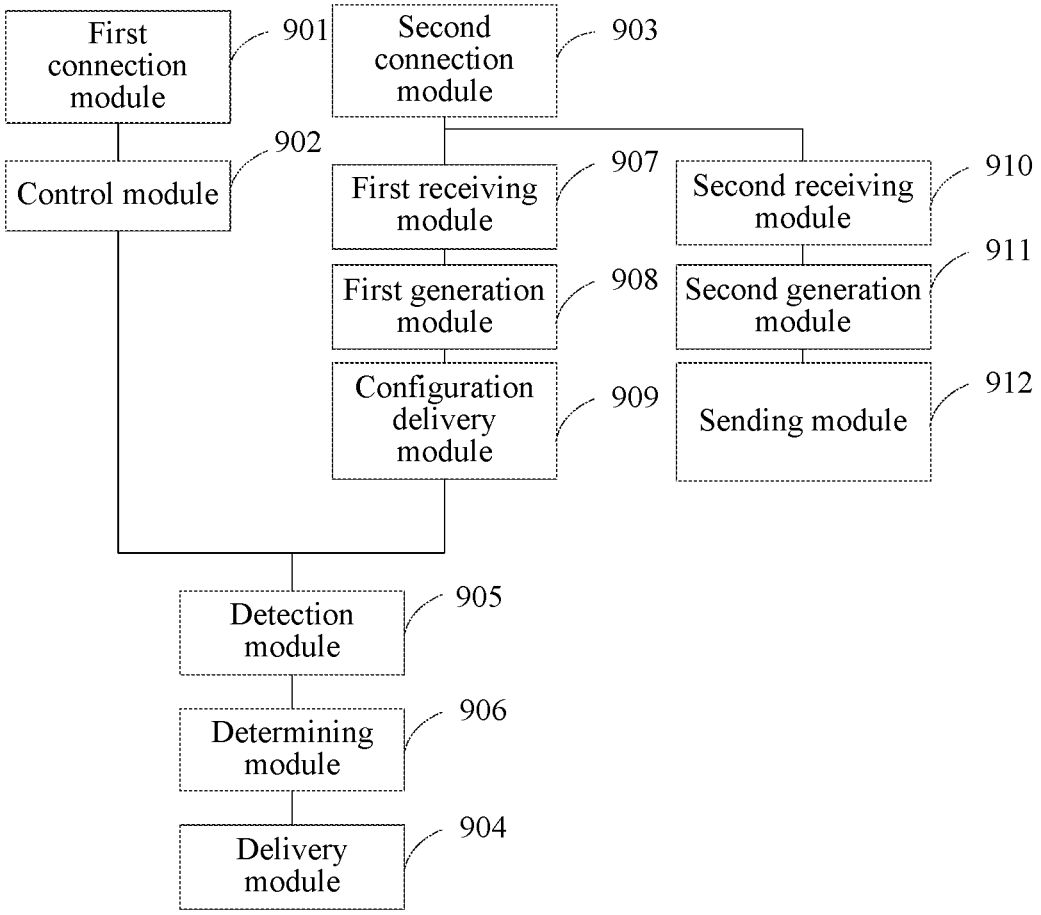
FIG. 9 is a structural block diagram of a device control apparatus according to an embodiment of the present disclosure.

Referring to FIG. 9, FIG. 9 is a structural block diagram of a device control apparatus according to an embodiment of the present disclosure. The device control apparatus may be implemented by using software, hardware or a combination thereof to become a part or all of the control device 110 shown in FIG. 1. The device control apparatus includes:

a first connection module 901, configured to establish a connection to a first battle game device; and a control module 902, configured to: send a corresponding control instruction to the first battle game device according to a received external control operation during a battle game, the first battle game device being configured to battle with a second battle game device according to the control instruction; and the second battle game device being configured to: obtain a relative position of the first battle game device during the battle game, and automatically battle according to the relative position.

In conclusion, according to the device control apparatus provided in this embodiment, by providing an automatic battle function for the second battle game device, when a user manually controls the first battle game device by using the control device, the second battle game device can simulates an effect of battling with the first battle game device according to a position of the first battle game device, to resolve a problem that when a battle is performed between the battle game devices, at least two players are needed to separately control their battle game devices, and when the quantity of players is less than 2, the battle cannot be performed; and achieving an effect that a single player can perform a battle between battle game devices by adding a battle game device having an automatic battle function.

Optionally, the apparatus further includes a second connection module 903 and a delivery module 904, where the second connection module 903 is configured to establish a connection to the second battle game device; and the delivery module 904 is configured to: during the battle game, receive battle game data reported by the first battle game device and the second battle game device; and deliver status update data to the first battle game device and the second battle game device according to the battle game data, where the status update data is obtained by means of calculation according to the battle game data; or the second connection module 903 is configured to establish a connection to the second battle game device; and the delivery module 904 is further configured to: during the battle game, receive battle game data reported by the first battle game device and the second battle game device; send the battle game data to a server; receive status update data sent by the server, where the status update data is obtained by means of calculation according to the battle game data; and deliver the status update data to the first battle game device and the second battle game device, where the battle game data includes attack data reported by an attacker when the attacker launches an attack and attacked data reported by an attacked party when the attacked party is attacked; the attacker is one of the first battle game device and the second battle game device; and the attacked party is the other of the first battle game device and the second battle game device; and the status update data includes at least one of a health point, a battle score, and a battle game device status.

Optionally, the apparatus further includes:

a detection module 905, configured to detect whether an attacker device identifier included in the attack data is the same as an attacker device identifier included in the attacked data; and a determining module 906, configured to determine, if the attacker device identifiers are the same, that the attack data matches the attacked data, where the delivery module 904 is further configured to determine the status update data according to the attack data and the attacked data that match.

Optionally, the apparatus further includes:

a first receiving module 907, configured to receive an automatic control parameter that is set for the second battle game device, where the automatic control parameter includes at least one of an initial health point, an attack type, an attack probability, and an evasion probability of the second battle game device;

a first generation module 908, configured to generate an automatic control configuration according to the automatic control parameter; and a configuration delivery module 909, configured to deliver the automatic control configuration to the second battle game device, where the second battle game device is configured to automatically battle according to the relative position of the first battle game device and the automatic control configuration, where the attack probability indicates a probability that the second battle game device launches an attack, and the evasion probability indicates a probability that the second battle game device evades an attack.

Optionally, the apparatus further includes:

a second receiving module 910, configured to receive the relative position of the first battle game device sent by the second battle game device;

a second generation module 911, configured to generate a corresponding execution instruction according to the relative position, a current status of the first battle game device, a current status of the second battle game device, and preset control logic; and a sending module 912, configured to send the execution instruction to the second battle game device, where the second battle game device is configured to perform a corresponding action according to the execution instruction.

In this embodiment, when the battle game devices launches attacks or are attacked, the battle game devices report corresponding attack data and attacked data to the control device. The control device or the server connected to the control device updates or delivers a device status of each battle game device according to the received data. Finally, the first battle game device and the second battle game device simulate a battle effect according to the delivered device statuses, thereby increasing the realness and interest of the battle process.

In this embodiment, when receiving multiple groups of attack data and attacked data, the control device performs matching on the attack data and the attacked data according to a matching mechanism, and further updates status data of corresponding battle game devices according to matched battle game data, thereby avoiding a mistake of device status settlement caused by that the control device receives multiple groups of attack data and attacked data in a short time.

In this embodiment, during the battle game, the second battle game device transmits data and an instruction to the control device in real time with help of the processing capability of the control device, so that the second battle game device can automatically battle according to more complex automatic control logic, thereby increasing the realness of the battle.

It should be noted that, the device control apparatus provided in the foregoing embodiment is described only through an example of division of the functional modules. In an actual application, the foregoing functions may be assigned according to needs to be implemented by different functional modules, that is, the internal structure of the control device is divided into different functional modules, so as to implement all or a part of the functions described above. In addition, the device control apparatus provided in the foregoing embodiments and the embodiments of the device control methods belong to one concept. For specific implementation procedures, refer to the method embodiments, and details are not described herein again.

Figure 10:
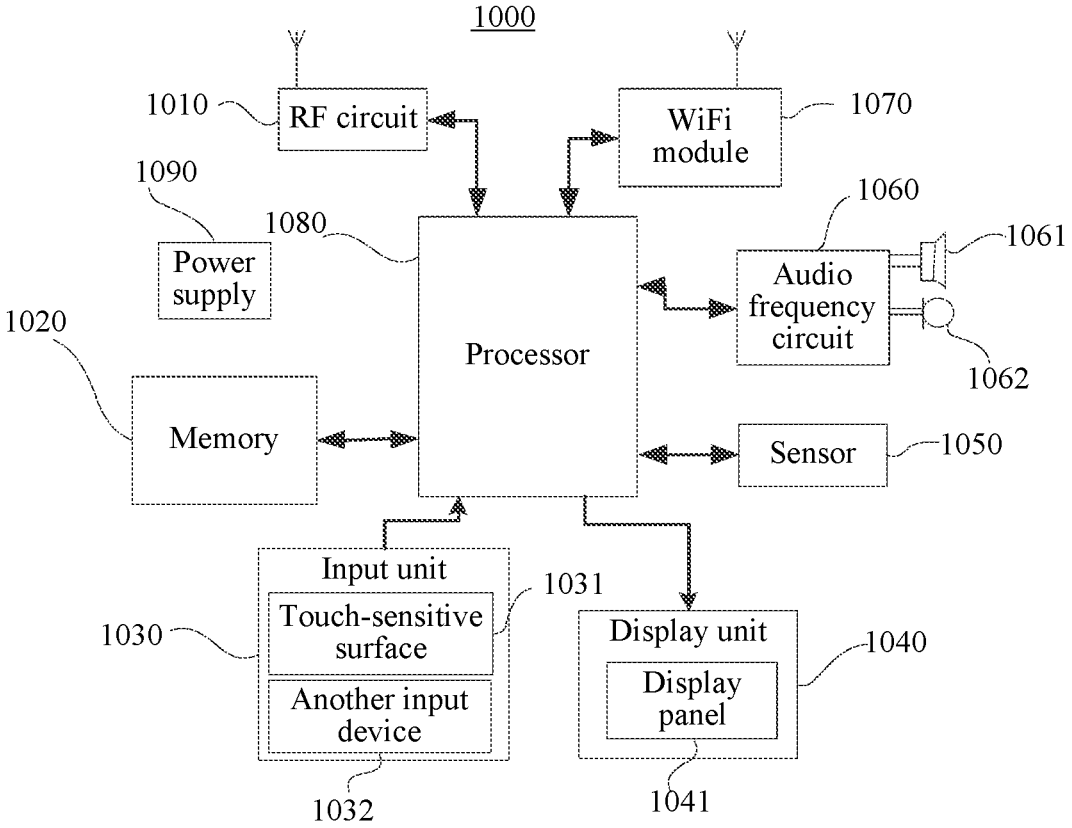
FIG. 10 is a schematic structural diagram of a control device according to an embodiment of the present disclosure.

FIG. 10 is a schematic structural diagram of a control device 1000 according to an embodiment of the present disclosure. The control device may be the control device 110 in FIG. 1.

The control device 1000 may include parts such as a radio frequency (RF) circuit 1010, a memory 1020 including one or more computer readable storage medium, an input unit 1030, a display unit 1040, a sensor 1050, an audio frequency circuit 1060, a short distance wireless transmission module 1070, a processor 1080 including one or more processing cores, and a power supply 1090. A person skilled in the art may understand that the control device structure shown in FIG. 10 does not constitute a limitation to the control device. The control device may include more or fewer parts than those shown in the figure, may combine some parts, or may have different part arrangements.

The RF circuit 1010 may be configured to receive and send signals during information receiving and sending or during a call. Particularly, the RF circuit 1010 receives downlink information from a base station, then delivers the downlink information to one or more processors 1080 for processing, and in addition, sends related uplink data to the base station. Generally, the RF circuit 1010 includes, but is not limited to, an antenna, at least one amplifier, a tuner, one or more oscillators, a subscriber identity module (SIM) card, a transceiver, a coupler, a low noise amplifier (LNA), and a duplexer. In addition, the RF circuit 1010 may also communicate with a network and another device by means of wireless communication. The wireless communication may use any communications standard or protocol, which includes, but is not limited to, a Global System for Mobile communications (GSM), a general packet radio service (GPRS), Code Division Multiple Access (CDMA), Wideband Code Division Multiple Access (WCDMA), Long Term Evolution (LTE), an email, Short Messaging Service (SMS), and the like.

The memory 1020 may be configured to store a software program and module. The processor 1080 performs various function applications and data processing by running the software program and module stored in the memory 1020. The memory 1020 may mainly include a program storage area and a data storage area. The program storage area may store an operating system, an application program required by at least one function (such as a sound playback function and an image display function), and the like. The data storage area may store data (such as audio data and an address book) created according to use of the control device 1000, and the like. In addition, the memory 1020 may include a high speed random access memory, and may further include a non-volatile memory, such as at least one magnetic disk storage device, a flash memory, or another volatile solid-state storage device. Correspondingly, the memory 1020 may further include a memory controller, to provide access of the processor 1080 and the input unit 1030 to the memory 1020. Although FIG. 10 shows the RF circuit 1010, it may be understood that the RF circuit 1010 is not a necessary component of the control device 1000, and when required, the RF circuit 1010 may be omitted as long as the scope of the essence of the present disclosure is not changed.

The input unit 1030 may be configured to receive input digit or character information, and generate a keyboard, mouse, joystick, optical or track ball signal input related to the user setting and function control. Specifically, the input unit 1030 may include a touch-sensitive surface 1031 and another input device 1032. The touch-sensitive surface 1031, also referred to as a touchscreen or a touch panel, may collect a touch operation of a user on or near the touch-sensitive surface (such as an operation of a user on or near the touch-sensitive surface 1031 by using any suitable object or accessory, such as a finger or a stylus), and drive a corresponding connection apparatus according to a preset program. Optionally, the touch-sensitive surface 1031 may include two parts: a touch detection apparatus and a touch controller. The touch detection apparatus detects a touch position of the user, detects a signal generated by the touch operation, and transmits the signal to the touch controller. The touch controller receives touch information from the touch detection apparatus, converts the touch information into touch point coordinates, and sends the touch point coordinates to the processor 1080. Moreover, the touch controller can receive and execute an instruction sent by the processor 1080. In addition, the touch-sensitive surface 1031 may be a resistive, capacitive, infrared, or surface sound wave type touch-sensitive surface. In addition to the touch-sensitive surface 1031, the input unit 1030 may further include the another input device 1032. Specifically, the another input device 1032 may include, but is not limited to:

one or more of a physical keyboard, a functional key (such as a volume control key or a switch key), a track ball, a mouse, and a joystick.

The display unit 1040 may be configured to display information input by the user or information provided for the user, and various graphical user interfaces of the control device 1000. The graphical user interfaces may be composed of graphics, text, icons, videos, and any combination thereof. The display unit 1040 may include a display panel 1041. Optionally, the display panel 1041 may be configured by using a liquid crystal display (LCD), an organic light-emitting diode (OLED), or the like. Further, the touch-sensitive surface 1031 may cover the display panel 1041. After detecting a touch operation on or near the touch-sensitive surface 1031, the touch-sensitive surface 1031 transfers the touch operation to the processor 1080, so as to determine a type of a touch event. Then, the processor 1080 provides corresponding visual output on the display panel 1041 according to the type of the touch event. Although, in FIG. 10, the touch-sensitive surface 1031 and the display panel 1041 are used as two separate parts to implement input and output functions, in some embodiments, the touch-sensitive surface 1031 and the display panel 1041 may be integrated to implement the input and output functions.

The control device 1000 may further include at least one sensor 1050 such as an optical sensor, a motion sensor, and other sensors. Specifically, the optical sensor may include an ambient light sensor and a proximity sensor. The ambient light sensor may adjust luminance of the display panel 1041 according to brightness of the ambient light. The proximity sensor may switch off the display panel 1041 and/or backlight when the control device 1000 is moved to the ear. As one type of motion sensor, a gravity acceleration sensor may detect magnitude of accelerations in various directions (generally on three axes), may detect magnitude and a direction of the gravity when static, and may be applied to an application that recognizes the attitude of the mobile phone (for example, switching between landscape orientation and portrait orientation, a related game, and magnetometer attitude calibration), a function related to vibration recognition (such as a pedometer and a knock), and the like. Other sensors such as a gyroscope, a barometer, a hygrometer, a thermometer, and an infrared sensor, which may be configured in the control device 1000, are not described in detail herein.

The audio frequency circuit 1060, a loudspeaker 1021, and a microphone 1022 may provide audio interfaces between the user and the control device 1000. The audio frequency circuit 1060 may convert received audio data into an electric signal and transmit the electric signal to the loudspeaker 1021. The loudspeaker 1021 converts the electric signal into a sound signal for output. On the other hand, the microphone 1022 converts a collected sound signal into an electric signal. The audio frequency circuit 1060 receives the electric signal and converts the electric signal into audio data, and outputs the audio data to the processor 1080 for processing. Then, the processor 1080 sends the audio data to, for example, another control device by using the RF circuit 1010, or outputs the audio data to the memory 1020 for further processing. The audio frequency circuit 1060 may further include an earplug jack, to provide communication between a peripheral earphone and the control device 1000.

The short distance wireless transmission module 1070 may be a wireless fidelity (WIFI) module, a Bluetooth module, or the like. The control device 1000 may perform, by using the short distance wireless transmission module 1070 information transmission with a wireless transmission module disposed on a battle game device.

The processor 1080 is a control center of the control device 1000, and connects to various parts of the entire control device by using various interfaces and lines. By running or executing the software program and/or module stored in the memory 1020, and invoking data stored in the memory 1020, the processor 1080 performs various functions and data processing of the control device 1000, thereby performing overall monitoring on the control device. Optionally, the processor 1080 may include one or more processing cores. Optionally, the processor 1080 may integrate an application processor and a modem processor. The application processor mainly processes an operating system, a user interface, an application program, and the like. The modem processor mainly processes wireless communication. It may be understood that the foregoing modem processor may alternatively not be integrated into the processor 1080.

The control device 1000 further includes the power supply 1090 (such as a battery) for supplying power to the components. Preferably, the power supply may be logically connected to the processor 1080 by using a power management system, thereby implementing functions such as charging, discharging, and power consumption management by using the power management system. The power supply 1090 may further include one or more of a direct current or alternating current power supply, a re-charging system, a power failure detection circuit, a power supply converter or inverter, a power supply state indicator, and any other components.

Although not shown in the figure, the control device 1000 may further include a camera, a Bluetooth module, and the like, which are not described herein.

The control device 1000 may further include a memory and one or more programs, where the one or more programs are stored in the memory, and the one or more programs are configured to be performed by one or more processors.

In an exemplary embodiment, a non-transitory computer readable storage medium including an instruction is further provided, for example, a memory including an instruction, and the foregoing instruction may be executed by a processor of a control device, to perform each step of the control device side in the foregoing method embodiments. For example, the non-transitory computer readable storage medium may be a ROM, a RAM, a CD-ROM, a magnetic disk, an optical disc, or the like.

By configuring a second battle game device having an automatic battle function, when a user manually controls a first battle game device by using a control device, the second battle game device can simulates an effect of battling with the first battle game device according to a position of the first battle game device, to resolve a problem that when a battle is performed between the battle game devices, at least two players are needed to separately control their battle game devices, and when the quantity of players is less than 2, the battle cannot be performed; and achieving an effect that a single player can perform a battle between battle game devices by adding a battle game device having an automatic battle function.

It should be understood that, unless an exception is clearly specified in the context, the singular form ("a", "an", and "the") used herein is intended to include the plural form. It should be further understood that, "and/or" used herein includes any or all possible combinations of one or more items that are listed in an associated manner.

The sequence numbers of the foregoing embodiments of the present disclosure are merely for description purpose but do not indicate the preference of the embodiments.

The foregoing descriptions are merely preferred embodiments of the present disclosure, but are not intended to limit the present disclosure. Any modification, equivalent replacement, or improvement made within the spirit and principle of the present disclosure shall fall within the protection scope of the present disclosure.

What is claimed is:

1. A device control method, applied to a control device, comprising:

establishing a connection to a first battle game device and a second battle game device, respectively;

sending a control instruction to the first battle game device according to a received external control operation during a battle game, the control instruction being used to instruct the first battle game device to battle with the second battle game device according to the control instruction; and the second battle game device being configured to: obtain a relative position of the first battle game device during the battle game, and automatically battle according to the relative position;

receiving battle game data reported by the first and second battle game devices, wherein the battle game data comprises: attack data reported by an attacker and including a first attacker device identifier, and attacked data reported by an attacked party and including an attacked party device identifier and a second attacker device identifier; and each of the first and second battle game devices is either an attacker or an attacked party;

determining, in response to the first attacker device identifier being the same as the second attacker device identifier, that the attack data matches the attacked data;

determining the status update data in response to the attack data matching the attacked data; and delivering status update data to the first and second battle game devices according to the battle game data.

2. The method according to claim 1, wherein:

the status update data is obtained by means of calculation according to the battle game data;

and the status update data comprises at least one of a health point, a battle score, or a battle game device status.

3. The method according to claim 2, wherein the calculation according to the battle game data is performed on the control device to obtain the status update data.

4. The method according to claim 1, wherein delivering the status update data to the first battle device and the second battle device comprises:

sending the battle game data reported by the first battle game device and the second battle game device to a server, wherein the server performs the calculation according to the battle game data is performed on the control device to obtain the status update data;

receiving status update data sent by the server; and delivering the status update data received from the server to the first battle device and the second battle device.

5. The method according to claim 1, wherein after the establishing the connection to the second battle game device, the method further comprises:

receiving an automatic control parameter that is set for the second battle game device before the battle game, wherein the automatic control parameter comprises at least one of an initial health point, an attack type, an attack probability, or an evasion probability of the second battle game device;

generating an automatic control configuration according to the automatic control parameter; and delivering the automatic control configuration to the second battle game device, wherein the second battle game device is configured to automatically battle according to the relative position of the first battle game device and the automatic control configuration, wherein the attack probability indicates a probability that the second battle game device launches an attack, and the evasion probability indicates a probability that the second battle game device evades an attack.

6. The method according to claim 1, wherein after the establishing a connection to the second battle game device, the method further comprises:

receiving the relative position of the first battle game device sent by the second battle game device;

automatically generating an execution instruction according to the relative position, a current status of the first battle game device, a current status of the second battle game device, and a preset control logic; and sending the execution instruction to the second battle game device, wherein the second battle game device is configured to perform an action according to the execution instruction.

7. A control device, comprising:

one or more processors; and a memory, wherein the one or more processors are configured to perform:

establishing a connection to a first battle game device and a second battle game device, respectively;

sending a control instruction to the first battle game device according to a received external control operation during a battle game, the control instruction being used to instruct the first battle game device to battle with the second battle game device according to the control instruction; and the second battle game device being configured to: obtain a relative position of the first battle game device during the battle game, and automatically battle according to the relative position;

receiving battle game data reported by the first and second battle game devices, wherein the battle game data comprises: attack data reported by an attacker and including a first attacker device identifier, and attacked data reported by an attacked party and including an attacked party device identifier and a second attacker device identifier; and each of the first and second battle game devices is either an attacker or an attacked party;

determining, in response to the first attacker device identifier being the same as the second attacker device identifier, that the attack data matches the attacked data;

determining the status update data in response to the attack data matching the attacked data; and delivering status update data to the first and second battle game devices according to the battle game data.

8. The control device according to claim 7, wherein the status update data is obtained by means of calculation according to the battle game data;

and the status update data comprises at least one of a health point, a battle score, or a battle game device status.

9. The control device according to claim 8, wherein the calculation according to the battle game data is performed by the one or more processors of the control device to obtain the status update data.

10. The control device according to claim 7, wherein delivering the status update data to the first battle device and the second battle device comprises:

sending the battle game data reported by the first battle game device and the second battle game device to a server, wherein the server performs the calculation according to the battle game data is performed on the control device to obtain the status update data;

receiving status update data sent by the server; and delivering the status update data received from the server to the first battle device and the second battle device.

11. The control device according to claim 7, wherein the one or more processors are further configured to perform:

receiving an automatic control parameter that is set for the second battle game device, wherein the automatic control parameter comprises at least one of an initial health point, an attack type, an attack probability, or an evasion probability of the second battle game device;

generating an automatic control configuration according to the automatic control parameter; and delivering the automatic control configuration to the second battle game device, wherein the second battle game device is configured to automatically battle according to the relative position of the first battle game device and the automatic control configuration, wherein the attack probability indicates a probability that the second battle game device launches an attack, and the evasion probability indicates a probability that the second battle game device evades an attack.

12. The control device according to claim 7, wherein the one or more processors are further configured to perform:

receiving the relative position of the first battle game device sent by the second battle game device;

automatically generating a corresponding execution instruction according to the relative position, a current status of the first battle game device, a current status of the second battle game device, and a preset control logic; and sending the execution instruction to the second battle game device, wherein the second battle game device is configured to perform an action according to the execution instruction.

13. A non-transitory computer-readable storage medium storing computer program instructions executable by at least one processor to perform:

establishing a connection to a first battle game device and a second battle game device, respectively;

sending a control instruction to the first battle game device according to a received external control operation during a battle game, the control instruction being used to instruct the first battle game device to battle with the second battle game device according to the control instruction; and the second battle game device being configured to: obtain a relative position of the first battle game device during the battle game, and automatically battle according to the relative position;

receiving battle game data reported by the first and second battle game devices, wherein the battle game data comprises: attack data reported by an attacker and including a first attacker device identifier, and attacked data reported by an attacked party and including an attacked party device identifier and a second attacker device identifier; and each of the first and second battle game devices is either an attacker or an attacked party;

determining, in response to the first attacker device identifier being the same as the second attacker device identifier, that the attack data matches the attacked data;

determining the status update data in response to the attack data matching the attacked data; and delivering status update data to the first and second battle game devices according to the battle game data.

14. The storage medium according to claim 13, wherein:

the status update data is obtained by means of calculation according to the battle game data;

and the status update data comprises at least one of a health point, a battle score, or a battle game device status.

15. The storage medium according to claim 14, wherein the calculation according to the battle game data is performed by the one or more processors of the control device to obtain the status update data.

16. The storage medium according to claim 13, wherein delivering the status update data to the first battle device and the second battle device comprises:

sending the battle game data reported by the first battle game device and the second battle game device to a server, wherein the server performs the calculation according to the battle game data is performed on the control device to obtain the status update data;

receiving status update data sent by the server; and delivering the status update data received from the server to the first battle device and the second battle device.

17. The storage medium according to claim 13, wherein the computer program instructions further cause the at least one processor to perform:

receiving an automatic control parameter that is set for the second battle game device, wherein the automatic control parameter comprises at least one of an initial health point, an attack type, an attack probability, or an evasion probability of the second battle game device;

generating an automatic control configuration according to the automatic control parameter; and delivering the automatic control configuration to the second battle game device, wherein the second battle game device is configured to automatically battle according to the relative position of the first battle game device and the automatic control configuration, wherein the attack probability indicates a probability that the second battle game device launches an attack, and the evasion probability indicates a probability that the second battle game device evades an attack.

* * * * *